US011003117B1

(12) United States Patent
Ota

(10) Patent No.: US 11,003,117 B1
(45) Date of Patent: May 11, 2021

(54) TEMPERATURE CONTROL DEVICE, IMAGE FORMING APPARATUS, AND TEMPERATURE CONTROL METHOD

(71) Applicant: TOSHIBA TEC KABUSHIKI KAISHA, Tokyo (JP)

(72) Inventor: Hiroshi Ota, Ota Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/993,131

(22) Filed: Aug. 13, 2020

(51) Int. Cl.
*G03G 15/20* (2006.01)
*G03G 15/00* (2006.01)

(52) U.S. Cl.
CPC ..... *G03G 15/2039* (2013.01); *G03G 15/5004* (2013.01); *G03G 15/5037* (2013.01); *G03G 2215/2038* (2013.01)

(58) Field of Classification Search
CPC ..... G03G 15/2039; G03G 15/5004; G03G 15/5037; G03G 2215/2038
See application file for complete search history.

(56) References Cited

U.S. PATENT DOCUMENTS 9,975,351 B1 * 5/2018 Luedeman ..... B41J 11/002

FOREIGN PATENT DOCUMENTS

JP H09-319255 A 12/1997

* cited by examiner

*Primary Examiner* — Clayton E. LaBalle
*Assistant Examiner* — Michael A Harrison
(74) *Attorney, Agent, or Firm* — Foley & Lardner LLP

(57) ABSTRACT

A temperature control device controls a temperature of a temperature control target to which heat is propagated from a heater by supplying power to the heater. The temperature control device includes processing circuitry that acquires a temperature measurement result of the temperature control target from a temperature sensor. The processing circuitry estimates an input voltage being supplied to the heater based on an energization time of the heater and a change in the temperature of the temperature control target during the energization time. The processing circuitry generates a temperature estimation result by estimating the temperature of the temperature control target based on a previous energization pulse used to control energization of the heater and the input voltage. The processing circuitry outputs the energization pulse to control the power supplied to the heater based on the temperature estimation result and the temperature measurement result.

20 Claims, 8 Drawing Sheets

FIG. 7

91

| TEMPERATURE RISE TIME [sec] | CORRECTION COEFFICIENT | INPUT VOLTAGE CONVERSION VALUE |
|---|---|---|
| t < X0 (7.3) | DETERMINATION BASED ON ACTUALLY MEASURED VALUE | NON-APPLICATION OF WAE CONTROL |
| X0 (7.3) ≦ t < X1 (8.2) | ×1.1 | 110% |
| X1 (8.2) ≦ t < X2 (11.0) | ×1.0 | 100% |
| X2 (11.0) ≦ t < X3 (16.5) | ×0.9 | 90% |
| X3 (16.5) ≦ t < X4 (22.0) | ×0.8 | 80% |
| X4 (22.0) ≦ t | DETERMINATION BASED ON ACTUALLY MEASURED VALUE | NON-APPLICATION OF WAE CONTROL |

FIG. 8

92

| TEMPERATURE RISE RATE [℃/sec] | CORRECTION COEFFICIENT | INPUT VOLTAGE CONVERSION VALUE |
|---|---|---|
| s > Y0 (17.7) | DETERMINATION BASED ON ACTUALLY MEASURED VALUE | NON-APPLICATION OF WAE CONTROL |
| Y0 (17.7) ≧ s > Y1 (15.8) | ×1.1 | 110% |
| Y1 (15.8) ≧ s > Y2 (11.8) | ×1.0 | 100% |
| Y2 (11.8) ≧ s > Y3 (7.9) | ×0.9 | 90% |
| Y3 (7.9) ≧ s > Y4 (5.9) | ×0.8 | 80% |
| Y4 (5.9) ≧ s | DETERMINATION BASED ON ACTUALLY MEASURED VALUE | NON-APPLICATION OF WAE CONTROL |

TEMPERATURE CONTROL DEVICE, IMAGE FORMING APPARATUS, AND TEMPERATURE CONTROL METHOD

FIELD

Embodiments described herein relate generally to a temperature control device, an image forming apparatus, and a temperature control method.

BACKGROUND

An image forming apparatus includes a fixing device that fixes a toner image on a print medium by applying heat and pressure to the print medium by the fixing device. The fixing device includes a rotating body (e.g., a heat roller or belt) for fixing, a pressurization member (e.g., a press roller), a heating member (e.g., a lamp or IH heater), and a temperature sensor. The temperature sensor measures a temperature of a surface of the heat roller.

A controller that controls the fixing device controls the surface temperature of the heat roller to reach a target value by increasing or decreasing an energization amount to a heater based on a measurement signal (e.g., a temperature sensor signal) of the temperature sensor.

If a deviation (or time lag) occurs between the temperature measured by the temperature sensor and the surface temperature of the heat roller, overshoot, temperature ripple, and the like may occur. For that reason, in order to prevent the occurrence of overshoot and temperature ripple, a temperature sensor (for example, a thermopile) having good responsiveness is required. However, temperature sensors having such good responsiveness are generally very expensive.

DESCRIPTION OF THE DRAWINGS

FIG. 7 is a table illustrating an example of the operation of the heater energization control circuit; and FIG. 8 is a table illustrating an example of the operation of the heater energization control circuit.

DETAILED DESCRIPTION

In general, according to one embodiment, there is provided a temperature control device that controls a temperature of a temperature control target to which heat is propagated from a heater by supplying power to the heater. The temperature control device includes an input voltage estimation unit, a temperature estimation unit, and a control signal generation unit. The input voltage estimation unit acquires a temperature measurement result of the temperature control target by a temperature sensor, and estimates an input voltage input to the heater based on an energization time to the heater and change in the temperature of the temperature control target during the energization time. The temperature estimation unit estimates the temperature of the temperature control target based on an energization pulse that controls energization to the heater and the input voltage. The control signal generation unit outputs the energization pulse for controlling the power to be supplied to the heater based on a temperature estimation result and the temperature measurement result.

Figure 1:
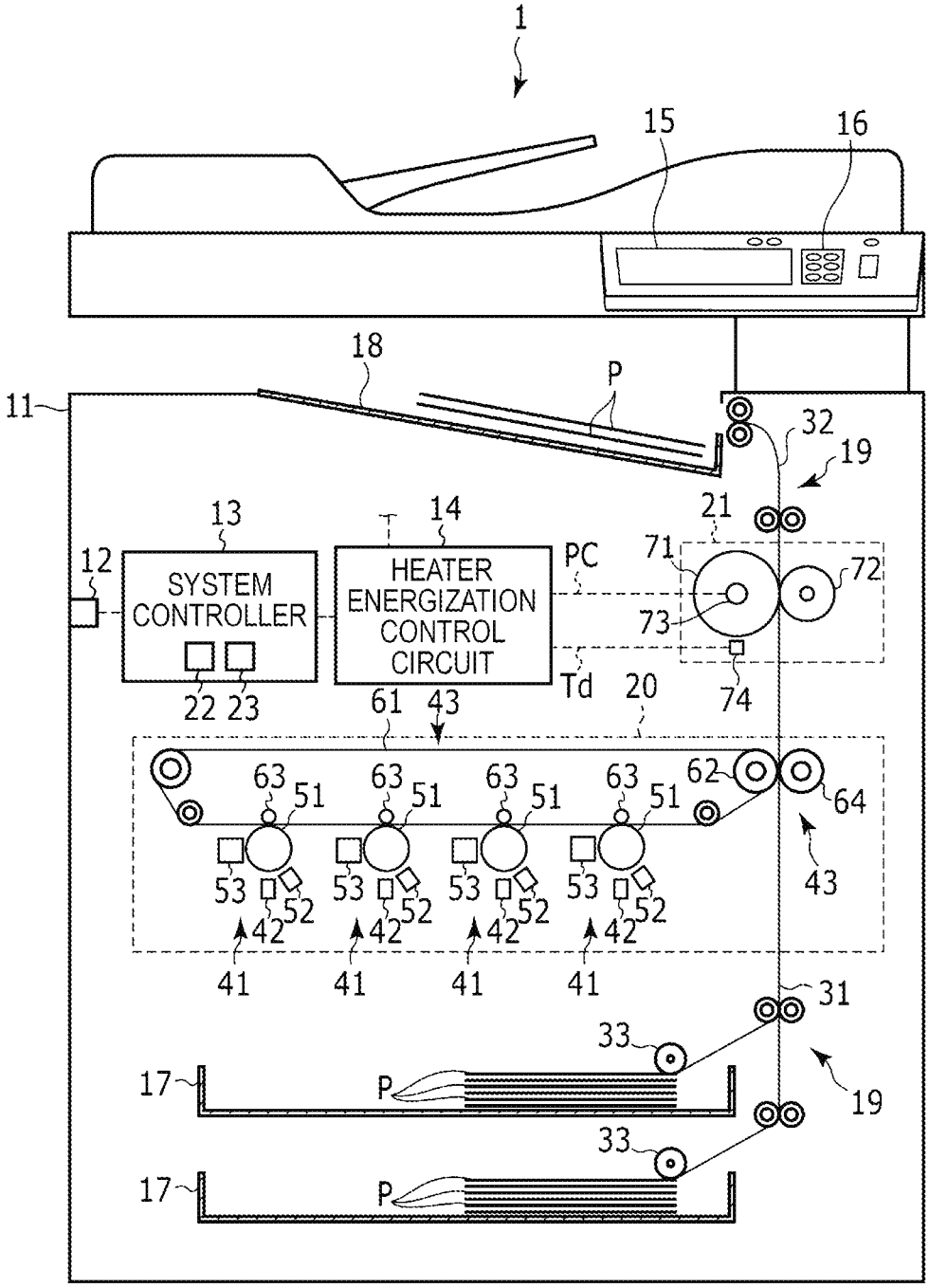
FIG. 1 is a diagram illustrating an example of a configuration of an image forming apparatus according to an embodiment.

Hereinafter, a temperature control device and an image forming apparatus according to at least one embodiment will be described with reference to the drawings. FIG. 1 is an explanatory diagram illustrating a configuration example of an image forming apparatus 1 according to an embodiment.

The image forming apparatus 1 is, for example, a multifunction printer (MFP) that performs various processing such as image formation while conveying a recording medium such as a print medium. The image forming apparatus 1 is, for example, a solid scanning type printer (for example, an LED printer) that scans an LED array and performs various processing such as image formation while conveying the recording medium such as the print medium.

For example, the image forming apparatus 1 is configured to receive a toner from a toner cartridge and form an image on the print medium with the received toner. The toner may be a monochrome toner or a color toner of colors such as cyan, magenta, yellow, and black. The toner may be a decolorable toner that decolors when heat is applied.

As illustrated in FIG. 1, the image forming apparatus 1 includes a casing 11, a communication interface 12, a system controller 13, a heater energization control circuit 14, a display unit 15, an operation interface 16, a plurality of paper sheet trays 17, a sheet discharge tray 18, a conveyance unit 19, an image forming unit 20, and a fixing device 21.

The casing 11 (e.g., a housing, a chassis, a frame) is a main body of the image forming apparatus 1. The casing 11 accommodates the communication interface 12, the system controller 13, the heater energization control circuit 14, the display unit 15, the operation interface 16, the plurality of paper sheet trays 17, the sheet discharge tray 18, the conveyance unit 19, the image forming unit 20, and the fixing device 21.

First, a configuration of a control system of the image forming apparatus 1 will be described. The communication interface 12 (e.g., a network interface) is an interface for communicating with other devices. The communication interface 12 is used, for example, for communication with a host device (e.g., an external device). The communication interface 12 is configured as a LAN connector or the like, for example. The communication interface 12 may be one that wirelessly communicates with other devices in compliance with a standard such as Bluetooth (registered trademark) or Wi-Fi (registered trademark).

The system controller 13 controls the image forming apparatus 1. The system controller 13 includes, for example, a processor 22 and a memory 23.

The processor 22 is an operation element that executes operation processing. The processor 22 is, for example, a CPU. The processor 22 performs various processing based on data such as a program stored in the memory 23. The processor 22 functions as a control unit capable of executing various operations by executing the program stored in the memory 23.

The memory 23 is a storage medium that stores a program, data used in the program, and the like. The memory 23 also functions as a working memory. That is, the memory 23 temporarily stores data being processed by the processor 22, the program executed by the processor 22, and the like.

The processor 22 performs various types of information processing by executing the program stored in the memory 23. For example, the processor 22 generates a print job based on an image acquired from the external device via the communication interface 12. The processor 22 stores the generated print job in the memory 23.

The print job includes image data indicating an image to be formed on a print medium P. The image data may be data for forming an image on one print medium P, or may be data for forming an image on a plurality of print media P. The print job includes information indicating color printing or monochrome printing. Furthermore, the print job may include information such as the number of printed copies (e.g., the number of page sets) and the number of prints (e.g., the number of pages) per copy.

The processor 22 generates print control information for controlling operations of the conveyance unit 19, the image forming unit 20, and the fixing device 21 based on the generated print job. The print control information includes information indicating the timing of paper sheet passing. The processor 22 supplies the print control information to the heater energization control circuit 14.

The processor 22 functions as a controller (e.g., an engine controller) that controls the operations of the conveyance unit 19 and the image forming unit 20 by executing the program stored in the memory 23. That is, the processor 22 performs control of the conveyance of the print medium P by the conveyance unit 19, control of formation of an image on the print medium P by the image forming unit 20, and the like.

The image forming apparatus 1 may be configured to include an engine controller separate from the system controller 13. In this case, the engine controller performs the control of the conveyance of the print medium P by the conveyance unit 19, the control of formation of the image on the print medium P by the image forming unit 20, and the like. In this case, the system controller 13 supplies information required for control in the engine controller to the engine controller.

The image forming apparatus 1 includes a power conversion circuit (not illustrated) that supplies a DC voltage to various components in the image forming apparatus 1 using an AC voltage of an AC power supply AC. The power conversion circuit supplies the DC voltage required for the operations of the processor 22 and the memory 23 to the system controller 13. The power conversion circuit supplies the DC voltage required for image formation to the image forming unit 20. The power conversion circuit supplies the DC voltage required for conveying the print medium to the conveyance unit 19. The power conversion circuit supplies the DC voltage for driving the heater of the fixing device 21 to the heater energization control circuit 14.

The heater energization control circuit 14 is a temperature control device (e.g., a temperature control unit, a temperature controller, a thermostat) that controls energization to the heater of the fixing device 21 described later. The heater energization control circuit 14 generates energization power PC for energizing the heater of the fixing device 21 and supplies the energization power to the heater of the fixing device 21. A detailed description of the heater energization control circuit 14 will be provided later.

The display unit 15 (e.g., a user interface, an operator interface) includes a display that displays a screen according to a video signal input from a display control unit such as the system controller 13 or a graphic controller (not illustrated). For example, a screen for various settings of the image forming apparatus 1 is displayed on the display of the display unit 15.

The operation interface 16 (e.g., a user interface, an operator interface) is connected to an operation member (not illustrated). The operation interface 16 supplies an operation signal corresponding to the operation of the operation member to the system controller 13. The operation member is, for example, a touch sensor, a ten key, a power key, a paper sheet feed key, various function keys, or a keyboard. The touch sensor acquires information indicating a designated position in a certain area. The touch sensor inputs a signal indicating the touched position on the screen displayed on the display unit 15 to the system controller 13 by being configured as a touch panel integrated with the display unit 15.

Each of the plurality of paper sheet trays 17 is a cassette that stores the print medium P (e.g., sheets of paper). The paper sheet tray 17 is configured to be able to supply the print medium P from the outside of the casing 11. For example, the paper sheet tray 17 is configured to be drawable from the casing 11.

The sheet discharge tray 18 is a tray that supports the print medium P discharged from the image forming apparatus 1.

Next, a configuration for conveying the print medium P of the image forming apparatus 1 will be described. The conveyance unit 19 is a mechanism that conveys the print medium P in the image forming apparatus 1. As illustrated in FIG. 1, the conveyance unit 19 includes a plurality of conveyance paths. For example, the conveyance unit 19 includes a sheet feed conveyance path 31 and a sheet discharge conveyance path 32.

Each of the sheet feed conveyance path 31 and the sheet discharge conveyance path 32 is configured with a plurality of motors, a plurality of rollers, and a plurality of guides, which are not illustrated. Under the control of the system controller 13, the plurality of motors rotate a shaft to rotate rollers that are interlocked with the rotation of the shaft. The plurality of rollers rotate to move the print medium P. The plurality of guides control a conveyance direction of the print medium P.

In the sheet feed conveyance path 31, the print medium P is picked up from the paper sheet tray 17, and the picked-up print medium P is supplied to the image forming unit 20. The sheet feed conveyance path 31 includes a pickup roller 33 corresponding to each paper sheet tray. Each pickup roller 33 picks up the print medium P on the paper sheet tray 17 into the sheet feed conveyance path 31.

The sheet discharge conveyance path 32 is a conveyance path for discharging the print medium P on which an image is formed from the casing 11. The print medium P discharged through the sheet discharge conveyance path 32 is supported by the sheet discharge tray 18.

Next, the image forming unit 20 will be described. The image forming unit 20 is configured to form an image on the print medium P. Specifically, the image forming unit 20 forms an image on the print medium P based on the print job generated by the processor 22.

The image forming unit 20 includes a plurality of process units 41, a plurality of exposure devices 42, and a transfer mechanism 43. The image forming unit 20 includes the exposure device 42 for each process unit 41. Since the plurality of process units 41 and the plurality of exposure devices 42 each have the same configuration, one process unit 41 and one exposure device 42 will be respectively described.

First, the process unit 41 will be described. The process unit 41 is configured to form a toner image. For example, each of the plurality of process units 41 is provided for each type of toner. For example, the plurality of process units 41 correspond to color toners such as cyan, magenta, yellow, and black, respectively. Specifically, toner cartridges having different color toners are respectively connected to the process units 41.

The toner cartridge includes a toner storing container and a toner delivery mechanism. The toner storing container is a container that stores a toner. The toner delivery mechanism is a mechanism configured by a screw or the like for delivering the toner in the toner storing container.

The process unit 41 includes a photosensitive drum 51, an electrifying charger 52, and a developing device 53. The photosensitive drum 51 is a photoconductor including a cylindrical drum and a photosensitive layer formed on the outer peripheral surface of the drum. The photosensitive drum 51 rotates at a constant speed by a drive mechanism (not illustrated).

The electrifying charger 52 uniformly charges a surface of the photosensitive drum 51. For example, the electrifying charger 52 applies a voltage (e.g., a development bias voltage) to the photosensitive drum 51 using the electrifying roller to charge the photosensitive drum 51 to a uniform negative potential (e.g., a contrast potential). The electrifying roller is rotated by the rotation of the photosensitive drum 51 while applying a predetermined pressure to the photosensitive drum 51.

The developing device 53 adheres the toner to the photosensitive drum 51. The developing device 53 includes a developer container, an agitation mechanism, a developing roller, a doctor blade, an automatic toner control (ATC) sensor, and the like.

The developer container is a container that receives and stores the toner delivered from the toner cartridge. A carrier is previously stored in the developer container. The toner delivered from the toner cartridge is agitated with the carrier by the agitation mechanism to form developer in which the toner and the carrier are mixed. The carrier is stored in the developer container when the developing device 53 is manufactured.

The developing roller is rotated in the developer container to adhere the developer on the surface thereof. The doctor blade is a member disposed at a predetermined distance from the surface of the developing roller. The doctor blade removes a part of the developer adhering to the surface of the rotating developing roller. With this configuration, a layer of the developer having a thickness corresponding to the distance between the doctor blade and the surface of the developing roller is formed on the surface of the developing roller.

The ATC sensor is, for example, a magnetic flux sensor including a coil and measuring a voltage value generated in the coil. The measurement voltage of the ATC sensor changes depending on the density of magnetic flux from the toner in the developer container. That is, the system controller 13 determines a concentration ratio (e.g., a toner concentration ratio) of the toner remaining in the developer container to the carrier based on the measurement voltage of the ATC sensor. The system controller 13 operates an actuator, such as a motor (not illustrated), that drives the delivery mechanism of the toner cartridge based on the toner concentration ratio to deliver the toner from the toner cartridge to the developer container of the developing device 53.

Next, the exposure device 42 will be described. The exposure device 42 includes a plurality of light emitting elements. The exposure device 42 forms a latent image on the photosensitive drum 51 by irradiating the charged photosensitive drum 51 with light from the light emitting element. The light emitting element is, for example, a light emitting diode (LED). One light emitting element is configured to emit light to one point on the photosensitive drum 51. The plurality of light emitting elements are arranged in the main scanning direction which is a direction parallel to the rotation axis of the photosensitive drum 51.

The exposure device 42 irradiates the photosensitive drum 51 with light by the plurality of light emitting elements arranged in the main scanning direction to form a latent image for one line on the photosensitive drum 51. Furthermore, the exposure device 42 continuously irradiates the rotating photosensitive drum 51 with light to form latent images for a plurality of lines.

In the configuration described above, when the surface of the photosensitive drum 51 charged by the electrifying charger 52 is irradiated with light from the exposure device 42, an electrostatic latent image is formed. When the layer of the developer formed on the surface of the developing roller approaches the surface of the photosensitive drum 51, the toner contained in the developer adheres to the electrostatic latent image formed on the surface of the photosensitive drum 51. As a result, a toner image is formed on the surface of the photosensitive drum 51.

Next, the transfer mechanism 43 will be described. The transfer mechanism 43 is configured to transfer the toner image formed on the surface of the photosensitive drum 51 to the print medium P.

The transfer mechanism 43 includes, for example, a primary transfer belt 61, a secondary transfer counter roller 62, a plurality of primary transfer rollers 63, and a secondary transfer roller 64.

The primary transfer belt 61 is an endless belt wound around the secondary transfer counter roller 62 and a plurality of winding rollers. An inner surface (e.g., an inner peripheral surface) of the primary transfer belt 61 contacts the secondary transfer counter roller 62 and the plurality of winding rollers, and an outer surface (e.g., an outer peripheral surface) thereof faces the photosensitive drum 51 of the process unit 41.

The secondary transfer counter roller 62 is rotated by a motor (not illustrated). The secondary transfer counter roller 62 rotates to convey the primary transfer belt 61 in a predetermined conveyance direction. The plurality of winding rollers are configured to be freely rotatable. The plurality of winding rollers rotate according to the movement of the primary transfer belt 61 by the secondary transfer counter roller 62.

The plurality of primary transfer rollers 63 are configured to bring the primary transfer belt 61 into contact with the photosensitive drum 51 of the process unit 41. The plurality of primary transfer rollers 63 are provided so as to correspond to the photosensitive drums 51 of the plurality of process units 41. Specifically, the plurality of primary transfer rollers 63 are respectively provided at positions facing the corresponding photosensitive drums 51 of the process units 41 with the primary transfer belt 61 interposed therebetween. The primary transfer rollers 63 contact the inner peripheral surface side of the primary transfer belt 61 and displace the primary transfer belt 61 to the photosensitive drum 51 side. With this configuration, the primary transfer rollers 63 bring the outer peripheral surface of the primary transfer belt 61 into contact with the photosensitive drums 51.

The secondary transfer roller 64 is provided at a position facing the primary transfer belt 61. The secondary transfer roller 64 contacts the outer peripheral surface of the primary transfer belt 61 and applies pressure thereto. With this configuration, a transfer nip in which the secondary transfer roller 64 and the outer peripheral surface of the primary transfer belt 61 are in close contact with each other is formed. When the print medium P passes through the transfer nip, the secondary transfer roller 64 presses the print medium P passing through the transfer nip against the outer peripheral surface of the primary transfer belt 61.

The secondary transfer roller 64 and the secondary transfer counter roller 62 rotate to convey the print medium P supplied from the sheet feed conveyance path 31 while sandwiching the print medium P. With this configuration, the print medium P passes through the transfer nip.

In the configuration described above, when the outer peripheral surface of the primary transfer belt 61 contacts the photosensitive drum 51, the toner image formed on the surface of the photosensitive drum is transferred to the outer peripheral surface of the primary transfer belt 61. When the image forming unit 20 includes a plurality of process units 41, the primary transfer belt 61 receives the toner images from the photosensitive drums 51 of the plurality of process units 41. The toner image transferred to the outer peripheral surface of the primary transfer belt 61 is conveyed by the primary transfer belt 61 to the transfer nip where the secondary transfer roller 64 and the outer peripheral surface of the primary transfer belt 61 are in close contact with each other. When the print medium P is present in the transfer nip, the toner image transferred to the outer peripheral surface of the primary transfer belt 61 is transferred to the print medium P at the transfer nip.

Next, a configuration relating to fixing of the image forming apparatus 1 will be described. The fixing device 21 fixes the toner image on the print medium P onto which the toner image is transferred. The fixing device 21 operates under the control of the system controller 13 and the heater energization control circuit 14. The fixing device 21 includes a rotating body for fixing (e.g., a roller), a pressurization member, and a heating member. The rotating body for fixing is, for example, a heat roller 71. The pressurization member is, for example, a press roller 72. The heating member is, for example, a heater 73 that heats the heat roller 71. Furthermore, the fixing device 21 includes a temperature sensor (e.g., a thermal sensor) 74 that measures the temperature of the surface of the heat roller 71.

The heat roller 71 is a rotating body for fixing that is rotated by a motor (not illustrated). The heat roller 71 includes a metal core made of metal in a hollow shape, and an elastic layer formed on the outer periphery of the metal core. The inside of the metal core of the heat roller 71 is heated by the heater 73 disposed inside the metal core formed in a hollow shape. The heat generated inside the metal core is transferred to the surface (that is, the surface of the elastic layer) of the heat roller 71 which is the outside of the metal core.

The press roller 72 is provided at a position facing the heat roller 71. The press roller 72 includes a metal core made of metal with a predetermined outer diameter and an elastic layer formed on the outer periphery of the metal core. The press roller 72 applies pressure to the heat roller 71 by stress applied from a tension member (not illustrated). The pressure is applied from the press roller 72 to the heat roller 71 to form a nip (e.g., a fixing nip) in which the press roller 72 and the heat roller 71 are in close contact with each other. The press roller 72 is rotated by a motor (not illustrated). The press roller 72 rotates to move the print medium P entering the fixing nip and press the print medium P against the heat roller 71. Each of the heat roller 71 and the press roller 72 may include a release layer on the surface thereof.

The heater 73 is a device that generates heat (e.g., thermal energy) using energization power PC (e.g., electrical energy) supplied from the heater energization control circuit 14. The heater 73 is, for example, a halogen heater. The heater 73 causes the inside of the metal core of the heat roller 71 to generate heat by electromagnetic waves radiated from the halogen lamp heater by energizing the halogen lamp heater, which is a heat source, with the energization power PC supplied from the heater energization control circuit 14. The heater 73 may be, for example, an IH heater or a planar heater made of ceramic or stainless steel (SUS).

The temperature sensor 74 measures the temperature of the surface of the heat roller 71 or the air in the vicinity thereof. There may be a plurality of temperature sensors 74. For example, a plurality of temperature sensors 74 may be arranged in parallel with the rotation axis of the heat roller 71. The temperature sensor 74 may be provided at least at a position at which a change in the temperature of the heat roller 71 can be measured. The temperature sensor 74 supplies a temperature measurement result Td indicating the measurement result to the heater energization control circuit 14.

With the configuration described above, the heat roller 71 and the press roller 72 apply heat and pressure to the print medium P passing through the fixing nip. The toner on the print medium P is melted by the heat applied from the heat roller 71, and is coated on the surface of the print medium P by the pressure applied by the heat roller 71 and the press roller 72. With this configuration, the toner image is fixed on the print medium P that passes through the fixing nip. The print medium P that passes through the fixing nip is introduced into the sheet discharge conveyance path 32 and discharged to the outside of the casing 11.

Next, the heater energization control circuit 14 (e.g., heater controller) will be described. The heater energization control circuit 14 controls energization to the heater 73 of the fixing device 21. The heater energization control circuit 14 generates the energization power PC for energizing the heater 73 of the fixing device 21, and supplies the energization power PC to the heater 73 of the fixing device 21.

Figure 2:
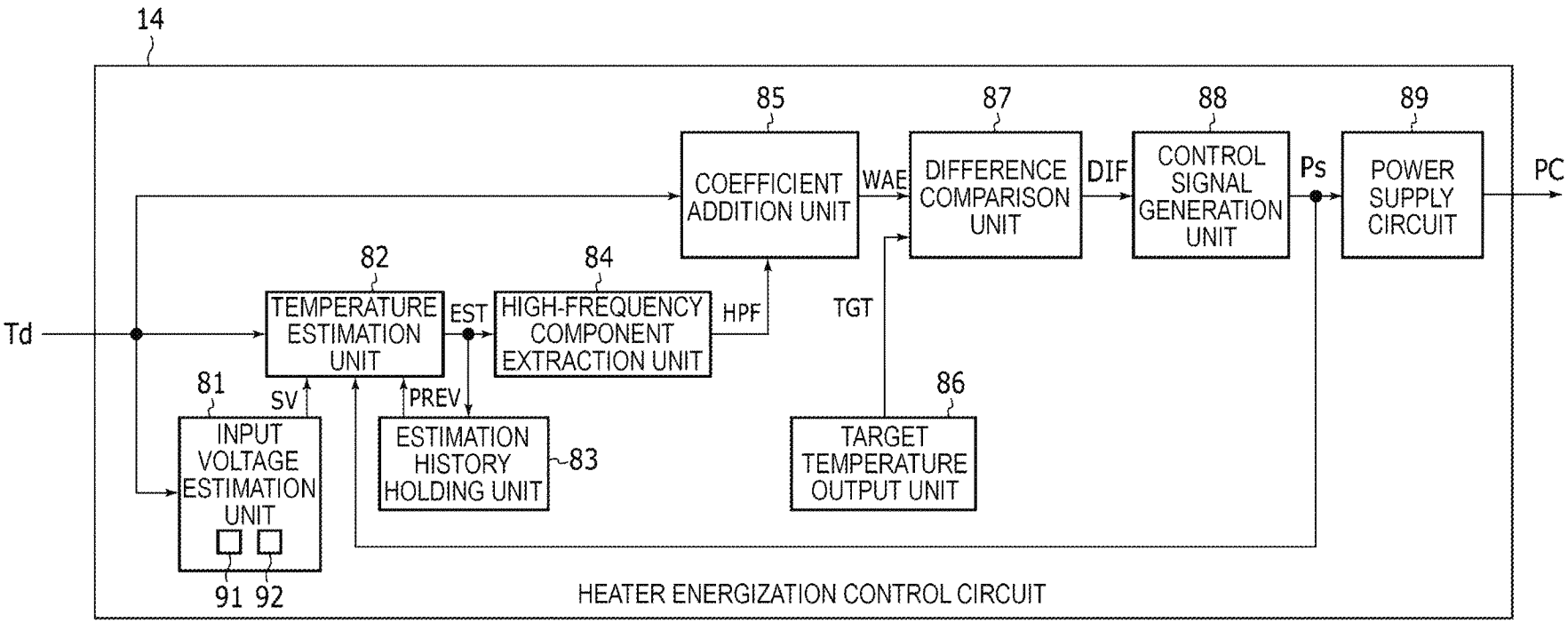
FIG. 2 is a diagram illustrating an example of a configuration of a heater energization control circuit.

As illustrated in FIG. 2, the heater energization control circuit 14 includes an input voltage estimation unit 81 (e.g., an input voltage estimator), a temperature estimation unit 82 (e.g., a temperature estimator), an estimation history holding unit 83 (e.g., estimation history storage), a high-frequency component extraction unit 84 (e.g., a high-frequency component extractor), a coefficient addition unit 85 (e.g., a coefficient adder), a target temperature output unit 86 (e.g., a target temperature outputter), a difference comparison unit 87 (e.g., a difference comparer), a control signal generation unit 88 (e.g., a control signal generator), and a power supply circuit 89 (e.g., a power supply, a power supplier). The temperature measurement result Td is input from the temperature sensor 74 to (e.g., received as an input by) the heater energization control circuit 14.

The input voltage estimation unit 81 estimates the voltage (e.g., the input voltage) to be supplied from the heater energization control circuit 14 to the heater 73. The temperature measurement result Td is input to the input voltage estimation unit 81 from the temperature sensor 74. The input voltage estimation unit 81 provides an input voltage estimation result SV based on the energization to the heater 73 and the temperature measurement result Td.

For example, the input voltage estimation unit 81 estimates the input voltage input to the heater 73 based on the energization time of the heater 73 and the increase (e.g., change) in the temperature of the heat roller 71, which is a temperature control target, during the energization time.

The energization time is a time (e.g., an elapsed time of warm-up operation) during which power is supplied from the heater energization control circuit 14 to the heater 73 of the fixing device 21 and the heat roller 71 is heated by the heater 73.

The input voltage estimation unit 81 includes, for example, a first estimation table 91 and a second estimation table 92.

The first estimation table 91 is information in which a range (having an upper limit and a lower limit) of the temperature rise time, a correction coefficient, and an input voltage conversion value are associated with each other.

The temperature rise time is a time required for the temperature measurement result Td input from the temperature sensor 74 to rise from a first state of being a first predetermined temperature (e.g., a first threshold value) or less to a second state of being a second predetermined temperature (e.g., a second threshold value higher than the first threshold value) or more during the warm-up operation. The first threshold value may be 40° C., for example.

The correction coefficient is a coefficient by which a rated voltage of DC voltage from the power conversion circuit is multiplied.

The input voltage conversion value indicates a value obtained by multiplying the rated voltage of DC voltage from the power conversion circuit described above by the correction coefficient.

The input voltage estimation unit 81 calculates the temperature rise time based on the energization time of the heater 73 (e.g., a time period during which the heater 73 is energized) and the increase in the temperature of the heat roller 71, which is the temperature control target, during the energization time. The input voltage estimation unit 81 refers to the first estimation table 91, acquires the input voltage conversion value associated with the calculated temperature rise time, and outputs the calculated temperature rise time to the temperature estimation unit 82 as the input voltage estimation result SV.

The input voltage estimation unit 81 may refer to the first estimation table 91, acquire the correction coefficient associated with the calculated temperature rise time, multiply the preset rated voltage by the correction coefficient, and output the multiplication result to the temperature estimation unit 82 as the input voltage estimation result SV.

The second estimation table 92 is information in which a range (having an upper limit and a lower limit) of a temperature rise rate, the correction coefficient, and the input voltage conversion value are associated with each other.

The temperature rise rate is a slope of the temperature increase calculated based on the temperature increased during a predetermined time during the warm-up operation. The temperature rise rate is a value calculated when heating by the heater 73 is performed from a state where the temperature measurement result Td input from the temperature sensor 74 is at least less than or equal to the first threshold value. The temperature rise rate is calculated, for example, based on the time required for the temperature measurement result Td input from the temperature sensor 74 to rise from a state of being a predetermined temperature (e.g., a first threshold value) or less to a predetermined temperature (e.g., the second threshold higher than the first threshold value) or more and the difference between the first threshold value and the second threshold value. The time used for calculating the temperature rise rate is not limited to the matters described above. For example, the temperature rise rate may be calculated based on the amount of increase in temperature for a predetermined time after the elapse of a predetermined time from the start of heating by the heater 73.

The input voltage estimation unit 81 calculates the temperature rise rate based on the energization time of the heater 73 and the increase in the temperature of the heat roller 71, which is the temperature control target, during the energization time. The input voltage estimation unit 81 refers to the second estimation table 92, acquires the input voltage conversion value associated with the calculated temperature rise rate, and outputs the input voltage conversion value to the temperature estimation unit 82 as the input voltage estimation result SV.

The input voltage estimation unit 81 may refer to the second estimation table 92, acquire the correction coefficient associated with the calculated temperature rise rate, multiply the preset rated voltage by the correction coefficient, and output the multiplication result to the temperature estimation unit 82 as the input voltage estimation result SV.

The temperature estimation unit 82 performs temperature estimation processing for estimating the temperature of the surface of the heat roller 71. The temperature measurement result Td from the temperature sensor 74, the input voltage estimation result SV from the input voltage estimation unit 81, an estimation history PREV from the estimation history holding unit 83, which will be described later, and an energization pulse Ps from the control signal generation unit 88, which will be described later, are input to the temperature estimation unit 82. The temperature estimation unit 82 generates a temperature estimation result EST based on the temperature measurement result Td, the input voltage estimation result SV, the estimation history PREV, and the energization pulse Ps. The temperature estimation unit 82 outputs the temperature estimation result EST to the estimation history holding unit 83 and the high-frequency component extraction unit 84.

The estimation history holding unit 83 holds a history of the temperature estimation result EST. The estimation history holding unit 83 outputs the estimated history PREV, which is the history (e.g., past temperature estimation result(s) EST) of the temperature estimation result EST, to the temperature estimation unit 82.

The high-frequency component extraction unit 84 performs high-pass filter processing for extracting a high-frequency component of the temperature estimation result EST. The high-frequency component extraction unit 84 outputs a high-frequency component HPF, which is a signal indicating the extracted high-frequency component, to the coefficient addition unit 85.

The coefficient addition unit 85 performs coefficient addition processing for correcting the temperature measurement result Td. The temperature measurement result Td from the temperature sensor 74 and the high-frequency component HPF from the high-frequency component extraction unit 84 are input to the coefficient addition unit 85. The coefficient addition unit 85 corrects the temperature measurement result Td based on the high-frequency component HPF. Specifically, the coefficient addition unit 85 multiplies the high-frequency component HPF by a preset coefficient and adds the multiplication result to the temperature measurement result Td to calculate a correction temperature value WAE (e.g., a corrected temperature value). The coefficient addition unit 85 outputs the correction temperature value WAE to the difference comparison unit 87.

The target temperature output unit 86 outputs a target temperature TGT, which is preset, to the difference comparison unit 87.

The difference comparison unit 87 performs difference computation processing. The difference comparison unit 87 calculates a difference DIF between the target temperature TGT from the target temperature output unit 86 and the correction temperature value WAE from the coefficient addition unit 85, and outputs the difference DIF to the control signal generation unit 88.

The control signal generation unit 88 generates the energization pulse Ps which is a pulse signal for controlling energization to the heater 73 based on the difference DIF. The control signal generation unit 88 outputs the energization pulse Ps to the power supply circuit 89 and the temperature estimation unit 82.

The power supply circuit 89 supplies the energization power PC to the heater 73 based on the energization pulse Ps. The power supply circuit 89 energizes the heater 73 of the fixing device 21 using a DC voltage supplied from a power conversion circuit (not illustrated). The power supply circuit 89 switches between a state where the DC voltage from the power conversion circuit is supplied to the heater 73 and a state where the DC voltage is not supplied, for example, based on the energization pulse Ps to supply the energizing power PC to the heater 73. That is, the power supply circuit 89 varies the energization time of the heater 73 of the fixing device 21 according to the energization pulse Ps.

The power supply circuit 89 may be integrated with the fixing device 21. That is, the heater energization control circuit 14 may be configured to supply the energization pulse Ps to the power supply circuit of the heater 73 of the fixing device 21 instead of being configured to directly supply the energization power PC to the heater 73.

As described above, the heater energization control circuit 14 adjusts the amount of power to the heater 73 of the fixing device 21 based on the temperature measurement result Td, the input voltage estimation result SV, the temperature estimation history PREV, and the energization pulse Ps. With this configuration, the heater energization control circuit 14 controls the surface temperature of the heat roller 71 heated by the heater 73. Such control is called weighted average control with estimate temperature (i.e., WAE control). Each of the input voltage estimation unit 81, the temperature estimation unit 82, the estimation history holding unit 83, the high-frequency component extraction unit 84, the coefficient addition unit 85, the target temperature output unit 86, the difference comparison unit 87, and the control signal generation unit 88 of the heater energization control circuit 14 may be configured by an electric circuit or may be configured by software.

Figure 3:
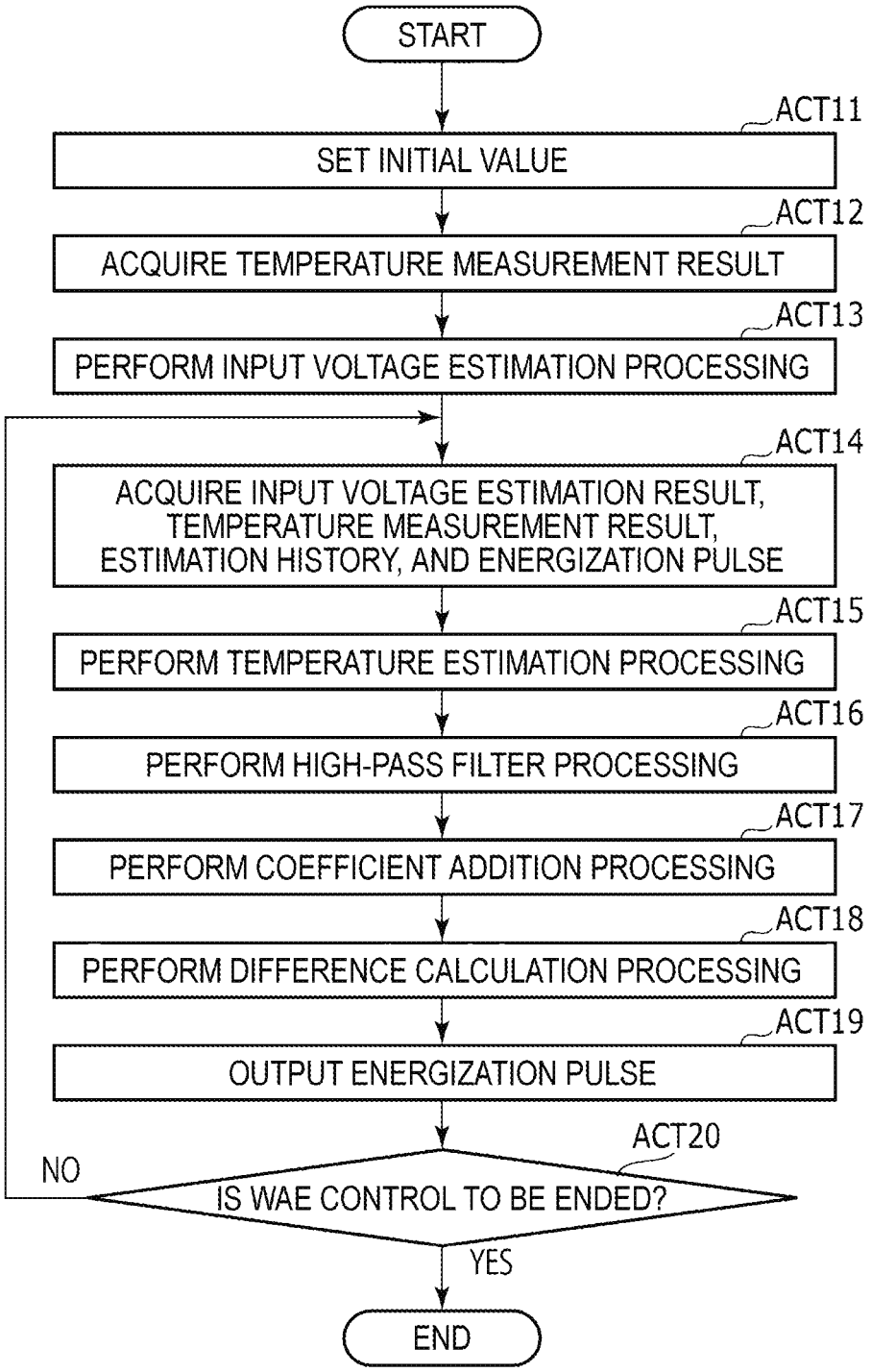
FIG. 3 is a flowchart illustrating an example of an operation of the heater energization control circuit.
Figure 4:
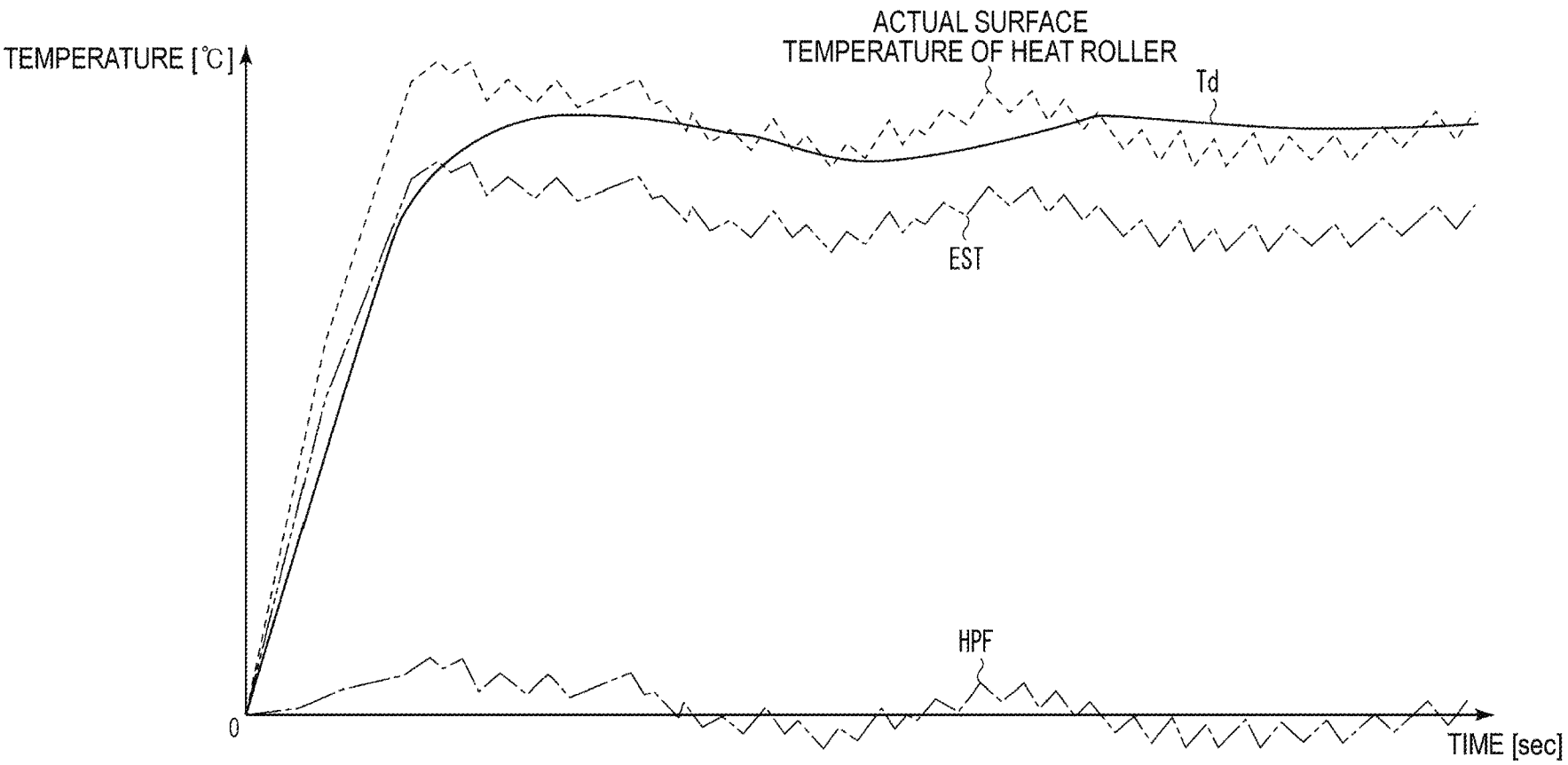
FIG. 4 is a graph illustrating an example of the operation of the heater energization control circuit.
Figure 5:
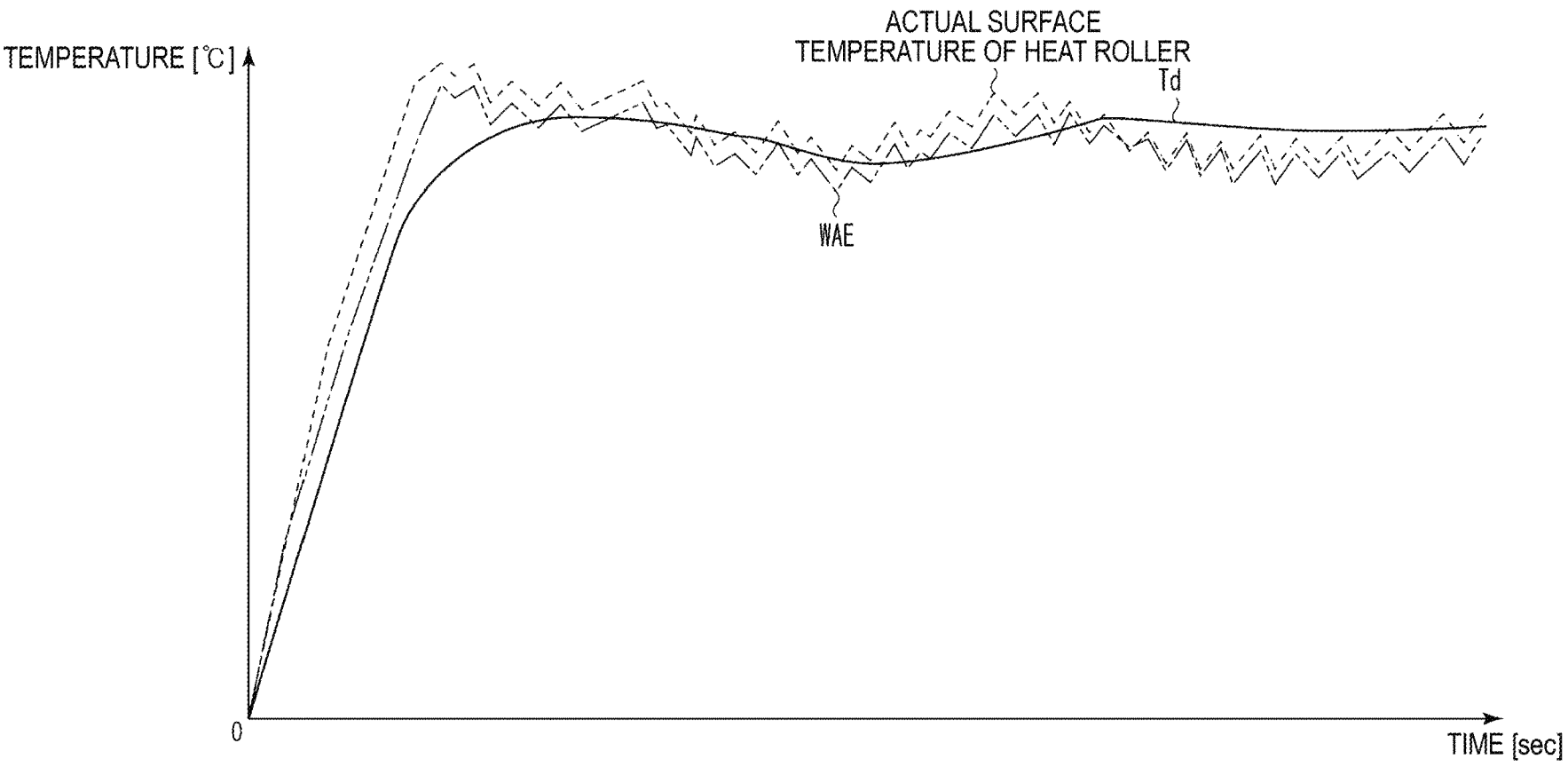
FIG. 5 is a graph illustrating an example of the operation of the heater energization control circuit.

The WAE control will be described in detail below. FIG. 3 is a flowchart for describing the WAE control. FIGS. 4 and 5 are explanatory graphs for describing each signal and the like in the WAE control. The horizontal axis in FIGS. 4 and 5 represents time. The vertical axis in FIGS. 4 and 5 represents temperature.

The heater energization control circuit 14 sets various initial values (ACT 11). For example, the heater energization control circuit 14 sets the rated voltage in the input voltage estimation unit 81, the coefficient in the coefficient addition unit 85, the target temperature TGT in the target temperature output unit 86, and the like based on the signal from the system controller 13.

The input voltage estimation unit 81 of the heater energization control circuit 14 sequentially acquires the temperature measurement result Td from the temperature sensor 74 (ACT 12).

The input voltage estimation unit 81 performs input voltage estimation processing for estimating the input voltage estimation result SV based on the energization time of the heater 73 during the warm-up operation and the increase (e.g., change) in the temperature of the heat roller 71, which is the temperature control target, during the energization time (ACT 13). The input voltage estimation unit 81 may be configured to calculate the temperature rise time, refer to the first estimation table 91, and output the input voltage estimation result SV to the temperature estimation unit 82, or may be configured to calculate the temperature rise rate, refer to the second estimation table 92, and output the input voltage estimation result SV to the temperature estimation unit 82.

The temperature estimation unit 82 of the heater energization control circuit 14 acquires the temperature measurement result Td from the temperature sensor 74, the input voltage estimation result SV from the input voltage estimation unit, the estimation history PREV from the estimation history holding unit 83, and the energization pulse Ps from the control signal generation unit 88 (ACT 14).

As illustrated in FIG. 4, a difference occurs between the temperature measurement result Td and the actual surface temperature of the heat roller 71. The surface temperature of the heat roller 71 changes in a fine cycle because heating by the heater 73 is performed intermittently. In contrast, the temperature sensor 74 may have poor responsiveness to a temperature change due to its own heat capacity and characteristics of the temperature-sensitive material. In particular, the cheaper the temperature sensor is, the worse the responsiveness tends to be. As a result, the temperature measurement result Td cannot accurately follow the actual surface temperature of the heat roller 71. That is, the temperature measurement result Td measured by the temperature sensor 74 is delayed with respect to the surface temperature of the heat roller 71. The temperature measurement result Td is measured by the temperature sensor 74 in a smoothed state where a fine change in the surface temperature of the heat roller 71 is not reproduced.

The temperature estimation unit 82 performs temperature estimation processing (ACT 15). That is, the temperature estimation unit 82 generates the temperature estimation result EST based on the input voltage estimation result SV, the temperature measurement result Td, the estimation history PREV, and the energization pulse Ps. The temperature estimation unit 82 outputs the temperature estimation result EST to the high-frequency component extraction unit 84 and the estimation history holding unit 83.

Heat transfer can be equivalently expressed by a CR time constant of an electric circuit. Heat capacity is replaced by (e.g., modeled as) a capacitor C. Resistance to heat transfer is replaced by (e.g., modeled as) a resistor R. A heat source is replaced by a DC voltage source. The temperature estimation unit 82 estimates a heat amount given to the heat roller 71 based on the model of the CR circuit in which the value of each element is preset, based on the energization amount supplied to the heater 73 and the heat capacity of the heat roller 71. The temperature estimation unit 82 estimates the surface temperature of the heat roller 71 based on the heat amount given to the heat roller 71, the temperature measurement result Td, and the estimation history PREV, and outputs the temperature estimation result EST.

In the temperature estimation unit 82, energization/interruption from the DC voltage source is repeated based on the energization pulse Ps, and an output voltage is generated by operating the CR circuit according to an input voltage pulse of the temperature estimation unit 82. With this configuration, it is possible to estimate heat that propagates to the surface of the heat roller 71 which is the control target.

The heat of the heat roller 71 flows out to the external environment through the space inside the fixing device 21 (and outside the heat roller 71). For that reason, the temperature estimation unit 82 further includes a CR circuit for estimating the outflow of heat from the heat roller 71 to the external environment. The temperature estimation unit 82 may further include a CR circuit for estimating the heat amount flowing from the heat roller 71 to the space inside the fixing device 21.

As illustrated in FIG. 4, the temperature estimation result EST appropriately follows change in the actual surface temperature of the heat roller 71. However, since the temperature estimation result EST is a simulation result, an absolute value thereof may differ from the actual surface temperature of the heat roller due to the difference in conditions.

The high-frequency component extraction unit 84 performs high-pass filter processing for extracting the high-frequency component of the temperature estimation result EST (ACT 16). As illustrated in FIG. 4, the high-frequency component HPF, which is a signal indicating the high-frequency component of the temperature estimation result EST, appropriately follows the change in the actual surface temperature of the heat roller 71.

The coefficient addition unit 85 performs coefficient addition processing for correcting the temperature measurement result Td (ACT 17). The coefficient addition unit 85 multiplies the high-frequency component HPF by a coefficient, which is preset, adds the high-frequency component HPF multiplied by the coefficient to the temperature measurement result Td, and calculates the correction temperature value WAE. That is, the coefficient addition unit 85 adjusts the value of the high-frequency component HPF added to the temperature measurement result Td with a coefficient to calculate the correction temperature value WAE.

For example, when the coefficient is 1, the coefficient addition unit 85 directly adds the high-frequency component HPF to the temperature measurement result Td. For example, when the coefficient is 0.1, the coefficient addition unit 85 adds the value of one tenth of the high-frequency component HPF to the temperature measurement result Td. In this case, the effect of the high-frequency component HPF is almost eliminated, and the correction temperature value WAE becomes close to the temperature measurement result Td. For example, when the coefficient is 1 or more, the effect of the high-frequency component HPF can be more strongly expressed. An experiment shows a result that, as the coefficient to be set in the coefficient addition unit 85, a value near 1 rather than an extreme value is better.

FIG. 5 is a graph illustrating an example of the actual surface temperature of the heat roller 71, the temperature measurement result Td, and the correction temperature value WAE. In the WAE control, a fine temperature change of the surface temperature of the heat roller 71 is estimated based on the temperature measurement result Td and the high-frequency component HPF of the temperature estimation result EST. Therefore, as illustrated in FIG. 5, the correction temperature value WAE is a value that appropriately follows the surface temperature of the heat roller 71.

The difference comparison unit 87 calculates the difference DIF between the target temperature TGT from the target temperature output unit 86 and the correction temperature value WAE from the coefficient addition unit 85, and outputs the difference DIF to the control signal generation unit 88 (ACT 18).

The control signal generation unit 88 generates the energization pulse Ps based on the difference DIF. The control signal generation unit 88 outputs the energization pulse Ps to the power supply circuit 89 and the temperature estimation unit 82 (ACT 19). The power supply circuit 89 supplies the energization power PC to the heater 73 based on the energization pulse Ps.

The relationship between the target temperature TGT and the correction temperature value WAE appears in the difference DIF. For example, when the correction temperature value WAE is greater than the target temperature TGT, the energization amount to the heater 73 is decreased and the surface temperature of the heat roller is lowered by performing control such as narrowing the width of the energization pulse Ps or reducing the frequency. Further, when the correction temperature value WAE is less than the target temperature TGT, the energization amount to the heater 73 is increased and the surface temperature of the heat roller is raised by performing control such as widening the width of the energization pulse Ps or increasing the frequency.

From the difference DIF, not only the vertical relationship between the correction temperature value WAE and the target temperature TGT but also how far the correction temperature value WAE and the target temperature TGT are apart from each other can be grasped. For example, when the difference DIF (e.g., the absolute value thereof) is a large value, the control described above may be greatly changed because the divergence between the correction temperature value WAE and the target temperature TGT is large. For example, when the difference DIF (e.g., the absolute value thereof) is a small value, the control described above may be performed gently because the divergence between the correction temperature value WAE and the target temperature TGT is small.

The processor 22 of the system controller 13 determines whether or not to end the WAE control (ACT 20). When the processor 22 determines to continue the WAE control, the processor 22 causes the process to proceed to processing of ACT 14. When the processor 22 determines to end the WAE control, the processor 22 ends the process in FIG. 3.

As described above, when performing processing of a certain cycle (i.e., the cycle), the heater energization control circuit 14 performs the WAE control based on the values (e.g., energization pulse Ps and temperature estimation result EST: estimation history PREV) in the immediately preceding cycle and the temperature measurement result Td in the cycle. That is, the heater energization control circuit 14 inherits the value in the next cycle. The heater energization control circuit 14 recomputes the temperature estimation computation based on the history of the previous computation. Accordingly, the heater energization control circuit 14 constantly performs computation during operation. In the heater energization control circuit 14, the computation result is held in a memory or the like and reused in the computation of the next cycle.

Figure 6:
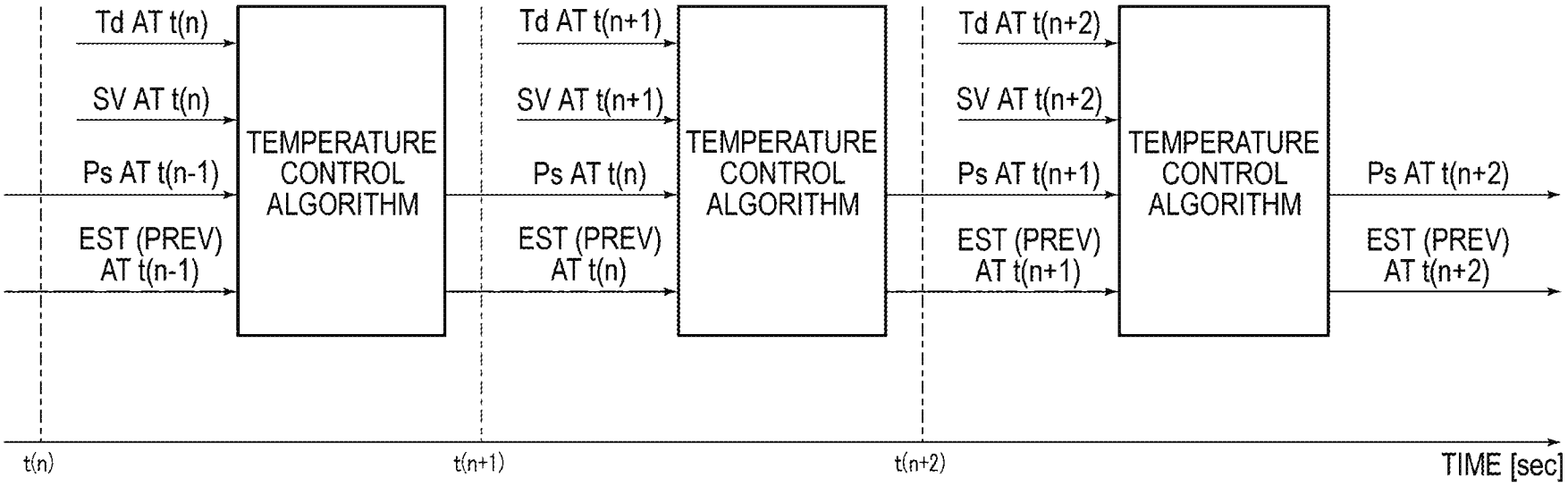
FIG. 6 is a diagram illustrating an example of the operation of the heater energization control circuit.

FIG. 6 is an explanatory diagram for describing a cycle of processing in the heater energization control circuit 14. The horizontal axis of FIG. 6 represents time. For example, the temperature estimation unit 82 performs temperature estimation processing at time t(n), performs the next temperature estimation processing at time t(n+1), which is a time advanced by the time dt from the time t(n), and performs the temperature estimation processing at time t(n+2), which is a time advanced by the time dt from the time t(n+1). In this way, the temperature estimation unit 82 repeatedly performs the temperature estimation processing. The temperature estimation unit 82 uses the previous temperature estimation result EST for new temperature estimation in the temperature estimation processing of each cycle.

At the time t(n), the input voltage estimation result SV at the time t(n), the temperature measurement result Td at the time t(n), the energization pulse Ps at time t(n−1) which is the previous time of the time t(n), and the temperature estimation result EST at the time t(n−1) (i.e., the estimation history PREV) which is the previous time of the time t(n) are input to the temperature estimation unit 82. The temperature estimation unit 82 performs processing based on the input signal and outputs the temperature estimation result EST at the time t(n). The high-frequency component extraction unit 84, the coefficient addition unit 85, the difference comparison unit 87, and the control signal generation unit 88 perform processing based on the input signal and output the energization pulse Ps at the time t(n).

At the time t(n+1), the input voltage estimation result SV at the time t(n+1), the temperature measurement result Td at the time t(n+1), the energization pulse Ps at time t(n) which is the previous time of the time t(n+1), and the temperature estimation result EST at the time t(n) (i.e., estimation history PREV) which is the previous time of the time t(n+1) are input to the temperature estimation unit 82. The temperature estimation unit 82 performs processing based on the input signal and outputs the temperature estimation result EST at the time t(n+1). The high-frequency component extraction unit 84, the coefficient addition unit 85, the difference comparison unit 87, and the control signal generation unit 88 perform processing based on the input signal and output the energization pulse Ps at the time t(n+1).

At the time t(n+2), the input voltage estimation result SV at the time t(n+2), the temperature measurement result Td at the time t(n+2), the energization pulse Ps at time t(n+1) which is the previous time of the time t(n+2), and the temperature estimation result EST at the time t(n+1) (i.e., estimation history PREV) which is the previous time of the time t(n+2) are input to the temperature estimation unit 82. The temperature estimation unit 82 performs processing based on the input signal and outputs the temperature estimation result EST at the time t(n+2). The high-frequency component extraction unit 84, the coefficient addition unit 85, the difference comparison unit 87, and the control signal generation unit 88 perform processing based on the input signal and output the energization pulse Ps at the time t(n+2).

The time interval dt may be a fixed value or may be configured to be set in the initial value setting of ACT 11. For example, the time interval dt is set to 100 [msec].

Next, the first estimation table 91 and the second estimation table 92 used for input voltage estimation processing will be described. FIG. 7 is an explanatory table for describing an example of the first estimation table 91. For example, when the temperature rise time t is t<X0 (7.3 seconds), it can be predicted that the input voltage is 110% or more with respect to a rated voltage 100%. In this case, the heater energization control circuit 14 controls energization to the heater 73 based on an actually measured value of the temperature measurement result Td measured by the temperature sensor 74 without performing the WAE control. Therefore, in the first estimation table 91, information indicating that the actually measured value of the temperature measurement result Td is used is associated with a range of the temperature rise time of t<X0 (7.3 seconds).

For example, when the temperature rise time t is X0 (7.3 seconds)≤t<X1 (8.2 seconds), it can be predicted that the input voltage is 105% or more and less than 110% with respect to the rated voltage 100%. In this case, the heater energization control circuit 14 outputs a value of a rated voltage 110% to the temperature estimation unit 82 as the input voltage estimation result SV. Therefore, in the first estimation table 91, information indicating that the value of the rated voltage 110% is used is associated with a range of the temperature rise time of X0 (7.3 seconds)≤t<X1 (8.2 seconds).

For example, when the temperature rise time t is X1 (8.2 seconds)≤t<X2 (11.0 seconds), it can be predicted that the input voltage is 95% or more and less than 105% with respect to the rated voltage 100%. In this case, the heater energization control circuit 14 outputs a value of the rated voltage 100% to the temperature estimation unit 82 as the input voltage estimation result SV. Therefore, in the first estimation table 91, information indicating that the value of the rated voltage 100% is used is associated with a range of the temperature rise time of X1 (8.2 seconds)≤t<X2 (11.0 seconds).

For example, when the temperature rise time t is X2 (11.0 seconds)≤t<X3 (16.5 seconds), it can be predicted that the input voltage is 85% or more and less than 95% with respect to the rated voltage 100%. In this case, the heater energization control circuit 14 outputs a value of a rated voltage 90% to the temperature estimation unit 82 as the input voltage estimation result SV. Therefore, in the first estimation table 91, information indicating that the value of the rated voltage 90% is used is associated with a range of the temperature rise time of X2 (11.0 seconds)≤t<X3 (16.5 seconds).

For example, when the temperature rise time t is X3 (16.5 seconds)≤t<X4 (22.0 seconds), it can be predicted that the input voltage is 80% or more and less than 85% with respect to the rated voltage 100%. In this case, the heater energization control circuit 14 outputs a value of a rated voltage 80% to the temperature estimation unit 82 as the input voltage estimation result SV. Therefore, in the first estimation table 91, information indicating that the value of the rated voltage 80% is used is associated with a range of the temperature rise time of X3 (16.5 seconds)≤t<X4 (22.0 seconds).

For example, when the temperature rise time t is X4 (22.0 seconds)≤t, it can be predicted that the input voltage is less than 80% with respect to the rated voltage 100%. In this case, the heater energization control circuit 14 controls the energization to the heater 73 based on the actually measured value of the temperature measurement result Td measured by the temperature sensor 74 without performing the WAE control. Therefore, in the first estimation table 91, information indicating that the actually measured value of the temperature measurement result Td is used is associated with the range of the temperature rise time of X4 (22.0 seconds)≤t.

The first estimation table 91 may be configured as a function representing the relationship between the temperature rise time and the correction coefficient by which the rated voltage is multiplied.

FIG. 8 is an explanatory table for describing an example of the second estimation table 92. For example, when the temperature rise rate s is s>Y0 (17.7° C./sec), it can be predicted that the input voltage is 110% or more with respect to a rated voltage 100%. In this case, the heater energization control circuit 14 controls energization to the heater 73 based on the actually measured value of the temperature measurement result Td measured by the temperature sensor 74 without performing the WAE control. Therefore, in the second estimation table 92, information indicating that the actually measured value of the temperature measurement result Td is used is associated with a range of the temperature rise rate of s>Y0 (17.7° C./sec).

For example, when the temperature rise rate s is Y0 (17.7° C./sec)≥s>Y1 (15.8° C./sec), it can be predicted that the input voltage is 105% or more and less than 110% with respect to the rated voltage 100%. In this case, the heater energization control circuit 14 outputs a value of a rated voltage 110% to the temperature estimation unit 82 as the input voltage estimation result SV. Therefore, in the second estimation table 92, information indicating that the value of the rated voltage 110% is used is associated with a range of the temperature rise rate of Y0 (17.7° C./sec)≥s>Y1 (15.8° C./sec).

For example, when the temperature rise rate s is Y1 (15.8° C./sec)≥s>Y2 (11.8° C./sec), it can be predicted that the input voltage is 95% or more and less than 105% with respect to the rated voltage 100%. In this case, the heater energization control circuit 14 outputs a value of the rated voltage 100% to the temperature estimation unit 82 as the input voltage estimation result SV. Therefore, in the second estimation table 92, information indicating that the value of the rated voltage 100% is used is associated with a range of the temperature rise rate of Y1 (15.8° C./sec)≥s>Y2 (11.8° C./sec).

For example, when the temperature rise rate s is Y2 (11.8° C./sec)≥s>Y3 (7.9° C./sec), it can be predicted that the input voltage is 85% or more and less than 95% with respect to the rated voltage 100%. In this case, the heater energization control circuit 14 outputs a value of a rated voltage 90% to the temperature estimation unit 82 as the input voltage estimation result SV. Therefore, in the second estimation table 92, information indicating that the value of the rated voltage 90% is used is associated with a range of the temperature rise rate of Y2 (11.8° C./sec)≥s>Y3 (7.9° C./sec).

For example, when the temperature rise rate s is Y3 (7.9° C./sec)≥s>Y4 (5.9° C./sec), it can be predicted that the input voltage is 80% or more and less than 85% with respect to the rated voltage 100%. In this case, the heater energization control circuit 14 outputs a value of a rated voltage 80% to the temperature estimation unit 82 as the input voltage estimation result SV. Therefore, in the second estimation table 92, information indicating that the value of the rated voltage 80% is used is associated with a range of the temperature rise rate of Y3 (7.9° C./sec)≥s>Y4 (5.9° C./sec).

For example, when the temperature rise rate s is Y4 (5.9° C./sec)≥s, it can be predicted that the input voltage is less than 80% with respect to the rated voltage 100%. In this case, the heater energization control circuit 14 controls the energization to the heater 73 based on the actually measured value of the temperature measurement result Td measured by the temperature sensor 74 without performing the WAE control. Therefore, in the second estimation table 92, information indicating that the actually measured value of the temperature measurement result Td is used is associated with the range of the temperature rise rate of Y4 (5.9° C./sec)≥s.

The second estimation table 92 may be configured as a function representing the relationship between the temperature rise rate and the correction coefficient by which the rated voltage is multiplied.

As described above, the image forming apparatus 1 includes the fixing device 21 including the heat roller 71 that heats the toner image formed on the medium to fix the toner image on the medium and the heater 73 that heats the heat roller 71, and a temperature control device (e.g., the heater energization control circuit 14). The heater energization control circuit 14 supplies power to the heater 73 to control the temperature of the heat roller 71 to which heat propagates from the heater 73. The heater energization control circuit 14 includes the input voltage estimation unit 81 which acquires the temperature measurement result Td of the heat roller 71 by the temperature sensor 74 and estimates the input voltage input to the heater 73 based on the energization time of the heater 73 and the increase (e.g., change) in the temperature of the heat roller 71 during the energization time. The heater energization control circuit 14 includes the temperature estimation unit 82 which estimates the temperature of the heat roller 71 based on the energization pulse Ps to the heater 73 and the input voltage to the heater 73. The heater energization control circuit 14 includes the control signal generation unit, which outputs an energization pulse for controlling the power to be supplied to the heater 73 based on the temperature estimation result and the temperature measurement result of the heat roller 71 by the temperature sensor 74.

According to such a configuration, the temperature control device can estimate the input voltage supplied to the heater 73 without using a voltage measurement device for measuring the actual value of the input voltage to the heater 73. With this configuration, even when the responsiveness of the temperature sensor 74 to measure the temperature of the heat roller 71 is poor, the temperature control device can follow the surface temperature of the heat roller 71 based on the temperature estimation result. With this configuration, the cost of the temperature sensor 74 and the cost of the voltage detector can be suppressed (e.g., reduced or eliminated), and occurrence of overshoot and temperature ripple due to the delay in temperature measurement can be prevented.

The input voltage estimation unit 81 calculates the input voltage input to the heater 73 based on the energization time required to reach a second temperature higher than a first temperature from a state of being lower than the first temperature. With this configuration, the temperature control device can estimate the input voltage input to the heater 73 based on the relationship between the temperature and time of the heat roller 71 during warm-up.

The input voltage estimation unit 81 calculates the temperature rise rate based on the amount of increase (e.g., the change amount) in temperature during the predetermined energization time. The input voltage estimation unit 81 calculates the input voltage input to the heater 73 based on the temperature rise rate. With this configuration, the temperature control device can more accurately estimate the input voltage input to the heater 73 based on the relationship between the temperature and the time of the heat roller 71 during warm-up.

The control signal generation unit 88 performs weighted averaging on the temperature estimation result and the temperature measurement result of the heat roller 71 by the temperature sensor 74, and outputs an energization pulse for controlling the power to be supplied to the heater 73 based on the weighted average result.

The image forming apparatus 1 further includes the high-frequency component extraction unit 84 that extracts the high-frequency component of the temperature estimation result. The control signal generation unit 88 outputs the energization pulse based on the temperature measurement result and the high-frequency component. With the configuration, it is possible to estimate a fine temperature change of the surface temperature of the heat roller 71 based on the high frequency component of the temperature estimation result while accurately estimating the absolute value of the surface temperature of the heat roller 71 based on the temperature measurement result. With this configuration, the heater 73 can be energized based on the result of accurately estimating the surface temperature of the heat roller 71. As a result, it is possible to prevent the occurrence of overshoot and temperature ripple due to the delay in temperature measurement.

The functionalities described in each of the embodiments described above are not limited to the configuration using hardware, and can also be realized by causing a computer to read a program describing the functionalities using software. The functionalities may be configured by appropriately selecting either software or hardware.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A temperature control device for controlling a temperature of a temperature control target to which heat is propagated from a heater by supplying power to the heater, the temperature control device comprising processing circuitry having programmed instructions to:

acquire, from a temperature sensor, a temperature measurement result of the temperature control target;

estimate an input voltage being supplied to the heater based on (a) an energization time of the heater and (b) a change in the temperature of the temperature control target during the energization time;

generate a temperature estimation result by estimating the temperature of the temperature control target based on (a) a previous energization pulse used to control energization of the heater and (b) the input voltage; and output an energization pulse to control the power supplied to the heater based on the temperature estimation result and the temperature measurement result.

2. The temperature control device of claim 1, wherein the energization time is a period during which the heater is energized and the temperature of the temperature control target is increasing.

3. The temperature control device of claim 2, wherein:

the energization time is a time required for the temperature control target to reach a second state from a first state;

the temperature of the temperature control target is less than or equal to a first predetermined temperature in the first state;

the temperature of the temperature control target is greater than or equal to a second predetermined temperature in the second state; and the second predetermined temperature is higher than the first predetermined temperature.

4. The temperature control device of claim 2, wherein the processing circuitry has programmed instructions to:

calculate a temperature rise rate based on an amount that the temperature of the temperature control target increases during the energization time; and estimate the input voltage being supplied to the heater based on the temperature rise rate.

5. The temperature control device of claim 1, wherein the processing circuitry has programmed instructions to:

extract a high-frequency component of the temperature estimation result; and output the energization pulse based on the temperature measurement result and the high-frequency component.

6. The temperature control device of claim 1, wherein the processing circuitry has programmed instructions to:

estimate the temperature of the temperature control target based on (a) a model of a CR circuit in which a heat capacity of the temperature control target is modeled as a capacitor and a resistance to heat transfer is modeled as a resistor, (b) the previous energization pulse, and (c) the input voltage.

7. The temperature control device of claim 1, wherein the processing circuitry has programmed instructions to:

output the energization pulse based on (a) a history of the temperature estimation result, (b) the previous energization pulse, (c) the temperature measurement result, and (d) the input voltage.

8. An image forming apparatus comprising:

a fixing device including:

a rotating body that is configured to heat a toner image formed on a medium to fix the toner image on the medium; and a heater configured to heat the rotating body; and a temperature control unit configured to control a temperature of the rotating body by supplying power to the heater, the temperature control unit having programmed instructions to:

acquire, from a temperature sensor, a temperature measurement result of the rotating body;

estimate an input voltage being supplied to the heater based on (a) an energization time of the heater and (b) a change in the temperature of the rotating body during the energization time;

generate a temperature estimation result by estimating the temperature of the rotating body based on (a) a previous energization pulse used to control energization of the heater and (b) the input voltage; and output an energization pulse to control the power supplied to the heater based on (a) the temperature estimation result and (b) the temperature measurement result.

9. The image forming apparatus of claim 8, wherein the energization time is a period during which the heater is energized and the temperature of the rotating body is increasing.

10. The image forming apparatus of claim 9, wherein:

the energization time is a time required for the rotating body to reach a second state from a first state;

the temperature of the rotating body is less than or equal to a first predetermined temperature in the first state;

the temperature of the rotating body is greater than or equal to a second predetermined temperature in the second state; and the second predetermined temperature is higher than the first predetermined temperature.

11. The image forming apparatus of claim 9, wherein the temperature control unit has programmed instructions to:

calculate a temperature rise rate based on an amount that the temperature of the rotating body increases during the energization time; and estimate the input voltage being supplied to the heater based on the temperature rise rate.

12. The image forming apparatus of claim 8, wherein the temperature control unit has programmed instructions to:

estimate the temperature of the rotating body based on (a) a history of the temperature estimation result, (b) the previous energization pulse, (c) the temperature measurement result, and (d) the input voltage.

13. The image forming apparatus of claim 12, wherein the temperature control unit has programmed instructions to:

extract a high-frequency component of the temperature estimation result; and output the energization pulse based on the temperature measurement result and the high-frequency component.

14. The image forming apparatus of claim 8, wherein the temperature control unit has programmed instructions to:

estimate the temperature of the rotating body based on (a) a model of a CR circuit in which a heat capacity of the rotating body is modeled as a capacitor and a resistance to heat transfer is modeled as a resistor, (b) the previous energization pulse, and (c) the input voltage.

15. A temperature control method for controlling a temperature of a temperature control target to which heat is propagated from a heater by supplying power to the heater, the method comprising:

acquiring, by a temperature sensor, a temperature measurement result of the temperature control target;

estimating, by a processor, an input voltage being supplied to the heater based on (a) an energization time of the heater and (b) a change in the temperature of the temperature control target during the energization time;

estimating, by the processor, the temperature of the temperature control target based on (a) a previous energization pulse used to control energization of the heater and (b) the input voltage, thereby generating a temperature estimation result; and outputting an energization pulse to control the power to be supplied to the heater based on the temperature estimation result and the temperature measurement result.

16. The temperature control method of claim 15, wherein the energization time is a period during which the heater is energized and the temperature of the temperature control target is increasing.

17. The temperature control method of claim 16, wherein:

the energization time is a time required for the temperature control target to reach a second state from a first state;

the temperature of the temperature control target is less than or equal to a first predetermined temperature in the first state;

the temperature of the temperature control target is greater than or equal to a second predetermined temperature in the second state; and the second predetermined temperature is higher than the first predetermined temperature.

18. The temperature control method of claim 16, further comprising:

calculating, by the processor, a temperature rise rate based on an amount that the temperature of the temperature control target increases during the energization time; and estimating, by the processor, the input voltage being supplied to the heater based on the temperature rise rate.

19. The temperature control method of claim 15, further comprising:

extracting, by the processor, a high-frequency component of the temperature estimation result; and outputting the energization pulse based on the temperature measurement result and the high-frequency component.

20. The temperature control method of claim 15, further comprising:

outputting the energization pulse based on (a) a history of the temperature estimation result, (b) the previous energization pulse, (c) the temperature measurement result, and (d) the input voltage.

* * * * *